US009316225B2

(12) United States Patent
Nagahara et al.

(10) Patent No.: US 9,316,225 B2
(45) Date of Patent: Apr. 19, 2016

(54) SCROLL COMPRESSOR WITH THRUST SLIDING SURFACE OILING GROOVE

(71) Applicant: DAIKIN INDUSTRIES, LTD., Osaka-shi, Osaka (JP)

(72) Inventors: Kenji Nagahara, Osaka (JP); Youhei Nishide, Osaka (JP); Takashi Uekawa, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 14/407,647

(22) PCT Filed: Apr. 18, 2013

(86) PCT No.: PCT/JP2013/002635
§ 371 (c)(1),
(2) Date: Dec. 12, 2014

(87) PCT Pub. No.: WO2013/186974
PCT Pub. Date: Dec. 19, 2013

(65) Prior Publication Data

US 2015/0147214 A1 May 28, 2015

(30) Foreign Application Priority Data

Jun. 14, 2012 (JP) ..... 2012-134471

(51) Int. Cl.
*F04C 18/02* (2006.01)
*F04C 27/00* (2006.01)
(Continued)

(52) U.S. Cl.
CPC ..... *F04C 18/0253* (2013.01); *F04C 18/0215* (2013.01); *F04C 27/005* (2013.01); *F04C 27/008* (2013.01); *F04C 27/02* (2013.01); *F04C 29/028* (2013.01); *F04C 29/023* (2013.01)

(58) Field of Classification Search
CPC .. F04C 18/0215; F04C 18/0253; F04C 27/02; F04C 29/028; F04C 18/02; F04C 29/02
See application file for complete search history.

(56) References Cited

U.S. PATENT DOCUMENTS 6,533,561 B1 3/2003 Furusho et al.
6,932,586 B2 * 8/2005 Furusho ..... F04C 18/0215 418/55.4

(Continued)

FOREIGN PATENT DOCUMENTS

JP 57-46001 A 3/1982
JP 59-87291 A 5/1984

(Continued)

OTHER PUBLICATIONS

International Preliminary Report of corresponding PCT Application No. PCT/JP2013/002635 dated Dec. 16, 2014.

(Continued)

*Primary Examiner* — Mary A Davis
(74) *Attorney, Agent, or Firm* — Global IP Counselors

(57) ABSTRACT

A scroll compressor includes a compression mechanism including fixed and movable scrolls. The fixed and movable scrolls have end plates and spiral laps. The laps are engaged to form a compression chamber. The end plates are in pressure contact around the compression chamber to form a thrust sliding surface. The thrust sliding surface has an oil groove extending around the compression chamber. High-pressure refrigerating machine oil is supplied to the oil groove. During orbiting of the orbiting scroll, at least in a region serving as a suction space of fluid in an outer peripheral portion of the compression chamber, an outer seal length from an outer peripheral edge of the oil groove in the thrust sliding surface to an outer edge of the movable end plate is smaller than an inner seal length from an inner peripheral edge of the oil groove to a peripheral edge of the compression chamber.

4 Claims, 9 Drawing Sheets

(51) Int. Cl.
*F04C 29/02* (2006.01)
*F04C 27/02* (2006.01)

(56) References Cited

U.S. PATENT DOCUMENTS

| | | | | |
|---|---|---|---|---|
| 7,438,539 | B2 * | 10/2008 | Kohsokabe | F04C 29/028 418/55.6 |
| 7,878,777 | B2 * | 2/2011 | Iwanami | F04C 18/0215 418/55.1 |
| 2004/0265159 | A1 | 12/2004 | Furusho et al. | |
| 2011/0158838 | A1 | 6/2011 | Nishide | |
| 2014/0010694 | A1 | 1/2014 | Tsuka et al. | |

FOREIGN PATENT DOCUMENTS

| | | | |
|---|---|---|---|
| JP | 2001-214872 | A | 8/2001 |
| JP | 2009-174500 | A | 8/2009 |
| JP | 2010-43641 | A | 2/2010 |
| JP | 2011-89493 | A | 5/2011 |
| JP | 2012-77627 | A | 4/2012 |
| JP | 2012-202221 | A | 10/2012 |

OTHER PUBLICATIONS

International Search Report of corresponding PCT Application No. PCT/JP2013/002635, issued on Jul. 16, 2013.
European Search Report of corresponding EP Application No. 13 80 4097.7 dated Jan. 19, 2016.

* cited by examiner

SCROLL COMPRESSOR WITH THRUST SLIDING SURFACE OILING GROOVE

CROSS-REFERENCE TO RELATED APPLICATIONS

This U.S. National stage application claims priority under 35 U.S.C. §119(a) to Japanese Patent Application No. 2012-134471, filed in Japan on Jun. 14, 2012, the entire contents of which are hereby incorporated herein by reference.

TECHNICAL FIELD

The present disclosure relates to scroll compressors, and particularly to a sealing structure of a thrust sliding surface between a fixed scroll and an orbiting scroll.

BACKGROUND ART

In a typical known scroll compressor, a pressing force toward a fixed scroll is applied to an orbiting scroll so as to prevent the orbiting scroll from moving away from the fixed scroll.

Japanese Unexamined Patent Publication No. 2001-214872 describes a scroll compressor in which high-pressure oil is supplied to the back surface of an orbiting scroll so that a pressing force toward a fixed scroll is applied to the orbiting scroll. This scroll compressor includes a seal ring that divides a back-pressure space at the back surface of the orbiting scroll into an inner first back-pressure space and an outer second back-pressure space. In the scroll compressor, high-pressure oil is supplied to the first back-pressure space, whereas the second back-pressure space serves as a low-pressure space, so that a pressing force is generated by a high-pressure force of the first back-pressure space.

In the scroll compressor, high-pressure oil is supplied to an oil groove formed in a thrust sliding surface between the fixed scroll and the orbiting scroll so that the pressing force is suppressed by a pushback force so as to prevent excessive pressing. The high-pressure oil supplied to the oil groove is distributed over the thrust sliding surface to be used for sealing as well as to lubricate the thrust sliding surface.

Japanese Unexamined Patent Publication No. 2010-043641 describes a scroll compressor including a communication passage that communicates a compression chamber and a back-pressure space in an end plate of an orbiting scroll. In the scroll pressure, refrigerant gas that is being compressed is introduced into the back-pressure space at the back surface of the orbiting scroll. In this scroll compressor, a pressure (i.e., an intermediate pressure) of refrigerant gas that is being compressed is caused to act on the back surface of the orbiting scroll, thereby pressing the orbiting scroll against the fixed scroll.

CITATION LIST

Patent Document

PATENT DOCUMENT 1: Japanese Unexamined Patent Publication No. 2001-214872

PATENT DOCUMENT 2: Japanese Unexamined Patent Publication No. 2010-043641

SUMMARY

Technical Problem

In a configuration in which an oil groove is formed in a thrust sliding surface between a fixed scroll and an orbiting scroll, when an outer second back-pressure space at the back surface of the orbiting scroll is at an intermediate pressure or a high pressure, oil does not easily spread over the thrust sliding surface, and thus, failures in lubrication and sealing might occur. This is because of the following reasons. When a space around the orbiting scroll is at a low pressure, the pressure difference causes high-pressure oil in the oil groove to flow into a compression chamber at a low pressure and a low-pressure space around the orbiting scroll and to spread over the entire thrust sliding surface. On the other hand, when the second back-pressure space comes to be at an intermediate pressure or a high pressure, almost all the high-pressure oil in the oil groove hardly flows into the second back-pressure space, but flows into the low-pressure compression chamber. Accordingly, oil does not spread to the outer peripheral portion of the oil groove so that no oil film is formed on the outer peripheral portion, and the outer peripheral portion is not sealed. Consequently, refrigerant flows from the second back-pressure space into a low-pressure portion at the suction side of the compression chamber, and the pressure of the second back-pressure space cannot be maintained any more, resulting in the possibility of overturn of the orbiting scroll.

It is therefore an object of the present disclosure to provide a scroll compressor that adjusts a pressing force of an orbiting scroll to a fixed scroll by forming an oil groove in a thrust sliding surface between the orbiting scroll and the fixed scroll and that can reduce overturn of the orbiting scroll and reduce failures in sealing and lubrication when a back-pressure space around the orbiting scroll is under an intermediate pressure or a high-pressure force.

Solution to the Problem

A scroll compressor in a first aspect of the disclosure is based on a scroll compressor including a compression mechanism (14) including a fixed scroll (4) in which a fixed end plate (41) and a spiral fixed lap (42) are integrated and an orbiting scroll (5) in which a movable end plate (51) and a spiral movable lap (52) are integrated, the fixed lap (42) and the movable lap (52) are engaged with each other and form a compression chamber (50), the fixed end plate (41) and the movable end plate (51) are in pressure contact with each other around the compression chamber (50) and form a thrust sliding surface (80), and an oil groove (81) to which high-pressure refrigerating machine oil is supplied is located in the thrust sliding surface (80) and extends around the compression chamber (50).

In the scroll compressor, during orbiting of the orbiting scroll (5), at least in a region serving as a suction space (50 L) of fluid in an outer peripheral portion of the compression chamber (50), an outer seal length (L1) from an outer peripheral edge of the oil groove (81) in the thrust sliding surface (80) to an outer edge (86) of the movable end plate (51) is smaller than an inner seal length (L2) from an inner peripheral edge of the oil groove (81) to a peripheral edge of the compression chamber (50).

In the first aspect, when an outer space (24) at the back surface of the movable end plate (51) is under an intermediate pressure or a high pressure, lubricating oil (refrigerating machine oil) in the oil groove (81) flows into a space at the back surface of the movable end plate (51) and a low-pressure space (i.e., a region communicating with a low-pressure side before a suction port is completely closed) at the suction side of the compression chamber (50). In this aspect, since the outer seal length (L1) of the orbiting scroll (5) is smaller than the inner seal length (L2) of the orbiting scroll (5) during orbiting, high-pressure oil in the oil groove (81) does not flow only into the low-pressure space at the suction side of the compression chamber (50) but also easily flows into the outer space (24) at the back surface of the movable end plate (51). Thus, oil easily spreads to an outer peripheral portion of the oil groove (81), and a difference in formation of an oil film does not easily occur between an inner peripheral portion and an outer peripheral portion of the oil groove (81).

In a second aspect of the disclosure, in the scroll compressor of the first aspect, in a state in which the outer seal length (L1) is at minimum when the orbiting scroll (5) orbits, the outer seal length (L1) is smaller than the inner seal length (L2).

In the second aspect, at least in a case where the outer seal length (L1) is at minimum when the orbiting scroll (5) orbits, the outer seal length (L1) is smaller than the inner seal length (L2). Thus, high-pressure oil in the oil groove (81) also always easily flows into the outer space (24) at the back surface of the movable end plate (51) during orbiting of the orbiting scroll (5). Accordingly, oil easily spreads to the outer peripheral portion of the oil groove (81).

In a third aspect of the disclosure, in the scroll compressor of the first or second aspect, the oil groove (81) has an outer peripheral chamfer (82) and an inner peripheral chamfer (83), and a size of the outer peripheral chamfer (82) is larger than a size of the inner peripheral chamfer (83).

In a fourth aspect of the disclosure, in the first or second aspect, an outer peripheral chamfer (82) is provided only in an outer peripheral portion of the oil groove (81).

In the third and fourth aspects, high-pressure oil easily flows into the outer peripheral portion of the oil groove (81), and thus, oil easily spreads to the outer peripheral portion of the oil groove (81).

In a fifth aspect of the disclosure, in any of the first through fourth aspects, a portion of the oil groove (81) corresponding to an inflow end of high-pressure oil is a proximal portion (81*a*), a portion of the oil groove (81) corresponding to a region in which the compression chamber (50) is a suction space (50 L) of fluid is a distal portion (81*b*), and at least one of a width or a depth of the distal portion (81*b*) is larger than that of the proximal portion (81*a*).

In the fifth aspect, high-pressure oil that has flowed from the proximal portion (81*a*) into the oil groove (81) has its pressure reduced toward the distal end as the width or depth of the oil groove (81) increases toward the distal portion (81*b*). In this manner, the pressure difference between the pressure of oil and the pressure at a low-pressure portion at the suction side of the compression chamber (50) decreases, and the amount of oil flowing into the compression chamber (50) decreases.

Advantages of the Invention

In the present disclosure, since the outer seal length (L1) is smaller than the inner seal length (L2) during orbiting of the orbiting scroll (5), when the outer space at the back surface of the movable end plate (51) is at an intermediate pressure or a high pressure, high-pressure oil in the oil groove (81) does not flow only into the low-pressure space at the suction side of the compression chamber (50) but also easily flows into the outer space (24) at the back surface of the movable end plate (51). Consequently, oil also easily spreads to the outer peripheral portion of the oil groove (81). Thus, a sealing failure is less likely to occur in the outer peripheral portion of the oil groove (81). As a result, the pressure of the back-pressure space at the back surface of the movable end plate (51) can be maintained, and overturn of the orbiting scroll (5) can be reduced, thereby reducing degradation of performance and reliability of the compressor. In addition, since a small amount of high-pressure oil flows from the low-pressure portion into the compression chamber (50), a decrease in efficiency of the compressor can also be reduced.

In the second aspect, high-pressure oil in the oil groove (81) always easily flows into the outer space (24) at the back surface of the movable end plate (51) during orbiting of the orbiting scroll (5), and oil easily spreads to the outer peripheral portion of the oil groove (81). Thus, a sealing failure is less likely to occur in the outer peripheral portion of the oil groove (81), and a decrease in performance caused by overturn of the orbiting scroll (5) can be reduced.

In the third and fourth aspects, the oil groove (81) has the inner peripheral chamfer (83) and the outer peripheral chamfer (82) such that the size of the outer peripheral chamfer (82) is larger than that of the inner peripheral chamfer (83) or the oil groove (81) has only the outer peripheral chamfer (82) so that no inner peripheral chamfer (83) is formed. Accordingly, high-pressure oil easily flows into the outer peripheral portion of the oil groove (81). Thus, oil easily spreads to the outer peripheral portion of the oil groove (81), and a sealing failure is less likely to occur in the outer peripheral portion of the oil groove (81).

In the fifth aspect, the width or the depth of the oil groove (81) increases toward the distal portion (81*b*). Thus, the pressure of high-pressure oil that has flowed from the proximal portion (81*a*) into the oil groove (81) decreases toward the distal end. Thus, the pressure difference between the pressure of oil and the pressure of the lower-portion at the suction side of the compression chamber (50) decreases, and a small amount of oil flows into the compression chamber (50) so that operation is performed efficiently. As a result, performance of the compressor is enhanced. In addition, unwanted oil discharge is reduced, thereby enhancing reliability of the compressor.

BRIEF DESCRIPTION OF THE DRAWINGS

FIG. 3A is a top view, and FIG. 3B is a sectional view taken along line b-b in FIG. 3A.

DESCRIPTION OF EMBODIMENTS

An embodiment of the present disclosure will be described in detail with reference to the drawings.

Figure 1:
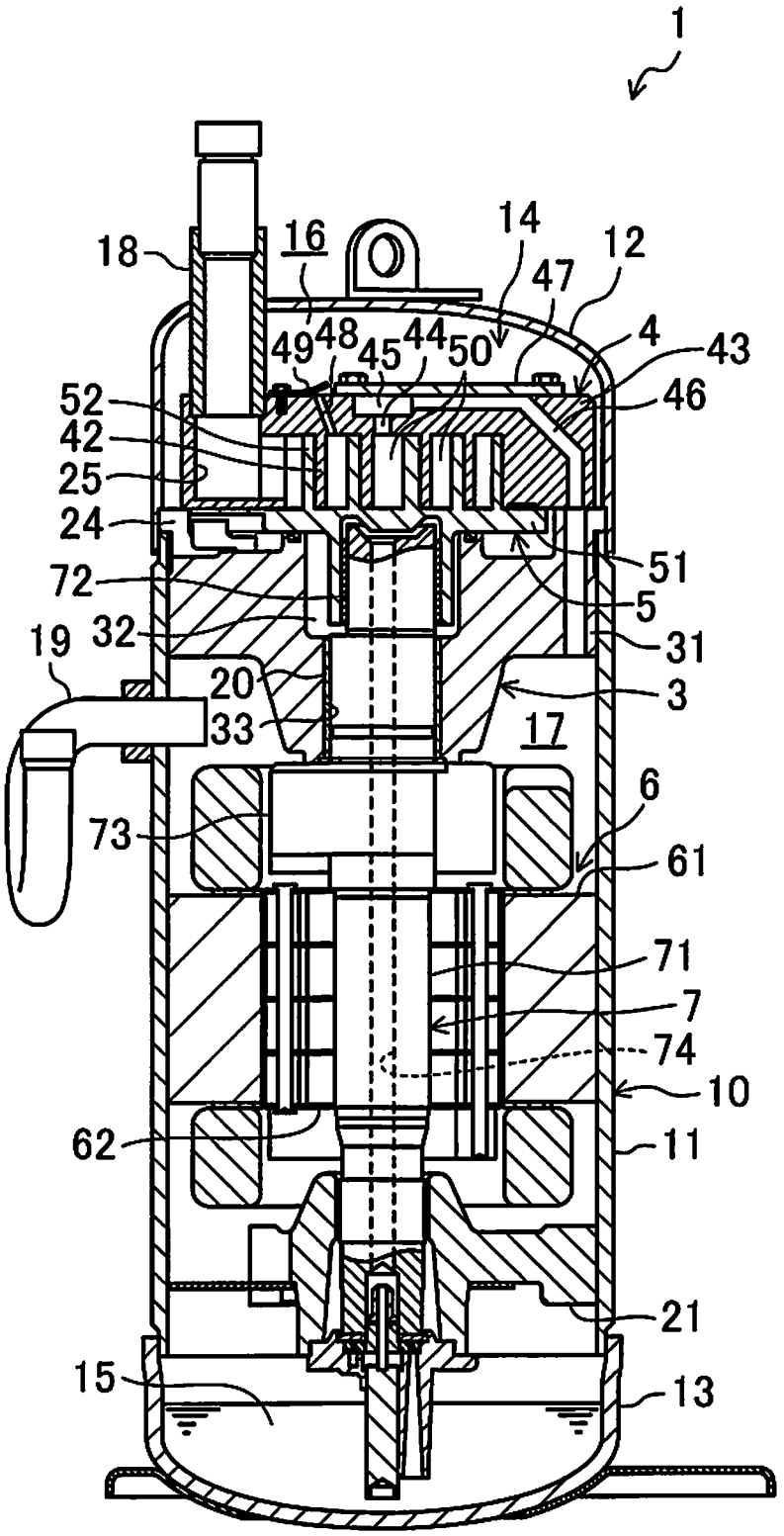
FIG. 1 is a vertical sectional view illustrating a scroll compressor according to an embodiment of the present disclosure.
Figure 2:
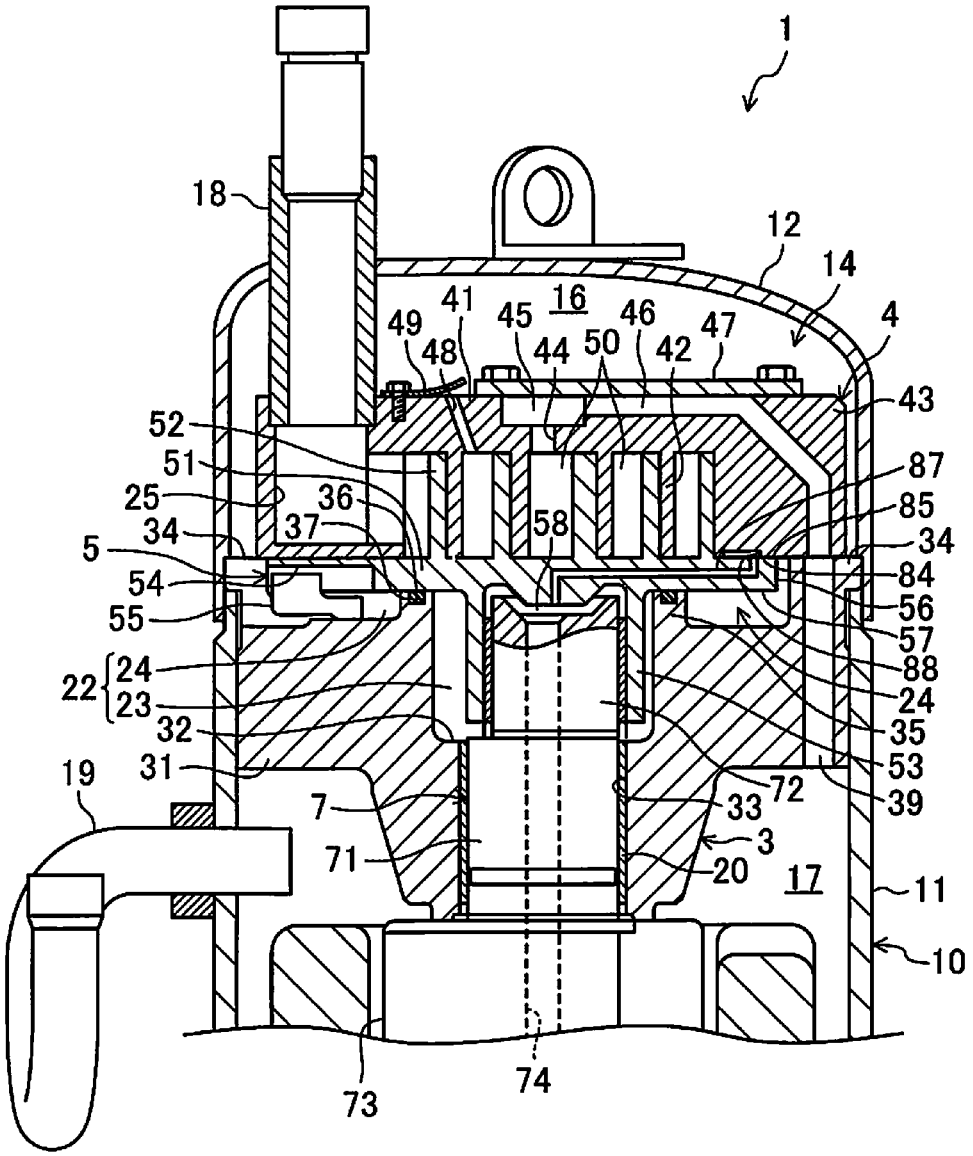
FIG. 2 is an enlarged sectional view illustrating a compression mechanism illustrated in FIG. 1.

FIG. 1 is a vertical sectional view illustrating a scroll compressor (1) according to the embodiment, and FIG. 2 is an enlarged view illustrating a main portion of FIG. 1. The scroll compressor (1) is connected to a refrigerant circuit (not shown) that performs a refrigeration cycle by circulating refrigerant, and compresses fluid refrigerant.

<Overall Configuration of Scroll Compressor>

The scroll compressor (1) is a hermetic compressor including a compression mechanism (14) that sucks and compresses refrigerant and a vertical hollow cylindrical casing (10) that houses the compression mechanism (14).

The casing (10) is a pressure vessel composed of a casing body (11), an upper wall (12), and a bottom wall (13). The casing body (11) is a cylindrical body having an axial line extending vertically. The upper wall (12) has a bowl shape with an upward convex surface and is hermetically welded to the upper end of the casing body (11). The bottom wall (13) has a bowl shape with a downward convex surface and is hermetically welded to the lower end of the casing body (11).

The casing (10) accommodates the compression mechanism (14) and an electric motor (6) that drives the compression mechanism (14). The electric motor (6) is located below the compression mechanism (14). The compression mechanism (14) and the electric motor (6) are coupled together by a driving shaft (7) extending vertically in the casing (10).

An oil sump (15) in which lubricating oil (refrigerating machine oil) is stored is formed at the bottom of the casing (10).

The upper wall (12) of the casing (10) is provided with a suction pipe (18) for guiding refrigerant in the refrigerant circuit to the compression mechanism (14). The casing body (11) is provided with a discharge pipe (19) for guiding refrigerant in the casing (10) to outside the casing (10).

The driving shaft (7) includes a main shaft (71), an eccentric portion (72), and a counterweight portion (73). The eccentric portion (72) has a relatively short shaft shape, and projects from the upper end of the main shaft (71). The shaft center of the eccentric portion (72) is eccentric away from the shaft center of the main shaft (71) by a predetermined distance. When the main shaft (71) of the driving shaft (7) rotates, the eccentric portion (72) revolves about the main shaft (71) in an orbit with a radius corresponding to an eccentricity amount from the main shaft (71). The counterweight portion (73) is integrally formed with the main shaft (71) in order to be dynamically balanced with, for example, an orbiting scroll (5), which will be described later, and the eccentric portion (72). In the driving shaft (7), an oil passage (74) extending from the top to the bottom of the driving shaft (7) is formed. The lower end of the driving shaft (7) is immersed in the oil sump (15).

The electric motor (6) includes a stator (61) and a rotor (62). The stator (61) is fixed to the casing body (11) by, for example, shrinkage fitting with heat. The rotor (62) is disposed inside the stator (61), and fixed to the main shaft (71) of the driving shaft (7). The rotor (62) is disposed substantially coaxially with the main shaft (71).

A lower bearing member (21) is provided in a lower portion of the casing (10). The lower bearing member (21) is fixed to a portion near the lower end of the casing body (11). A through hole is formed in a center portion of the lower bearing member (21), and the driving shaft (7) penetrates the through hole. The lower bearing member (21) supports the lower end of the driving shaft (7) such that the driving shaft (7) can rotate.

<Configuration of Compression Mechanism>

The compression mechanism (14) includes a housing (3), a fixed scroll (4), and an orbiting scroll (5). The housing (3) is fixed to the casing body (11). The fixed scroll (4) is disposed on the upper surface of the housing (3). The orbiting scroll (5) is disposed between the fixed scroll (4) and the housing (3).

Figure 3A:
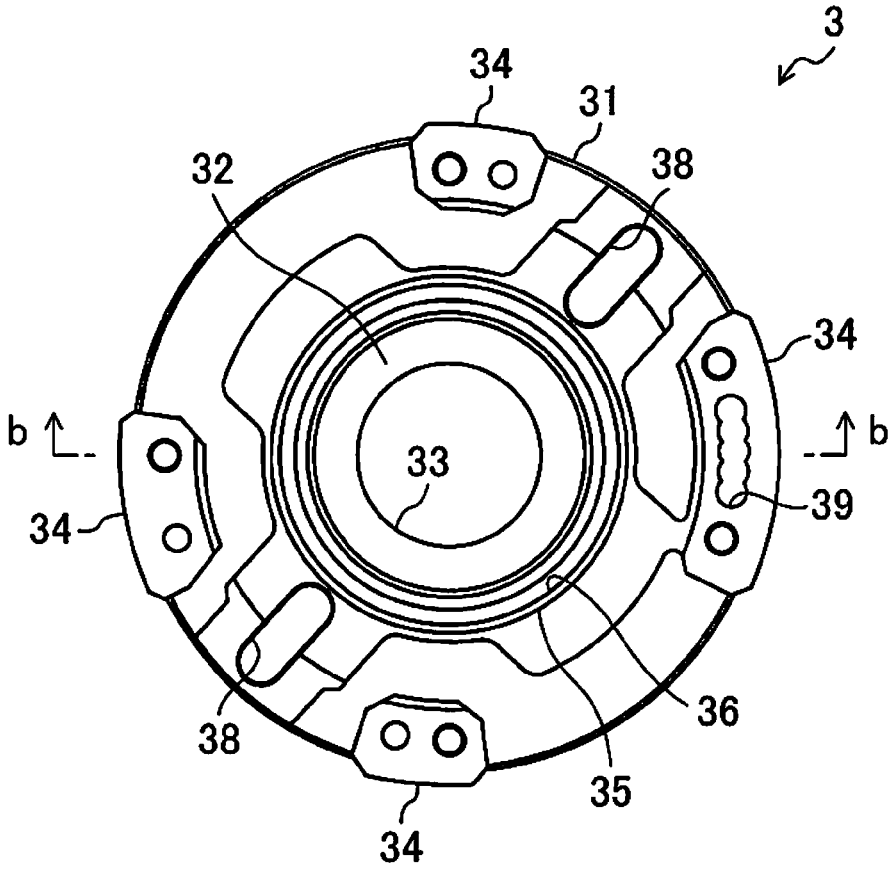
FIGS. 3A and 3B illustrate a housing.
Figure 3B:
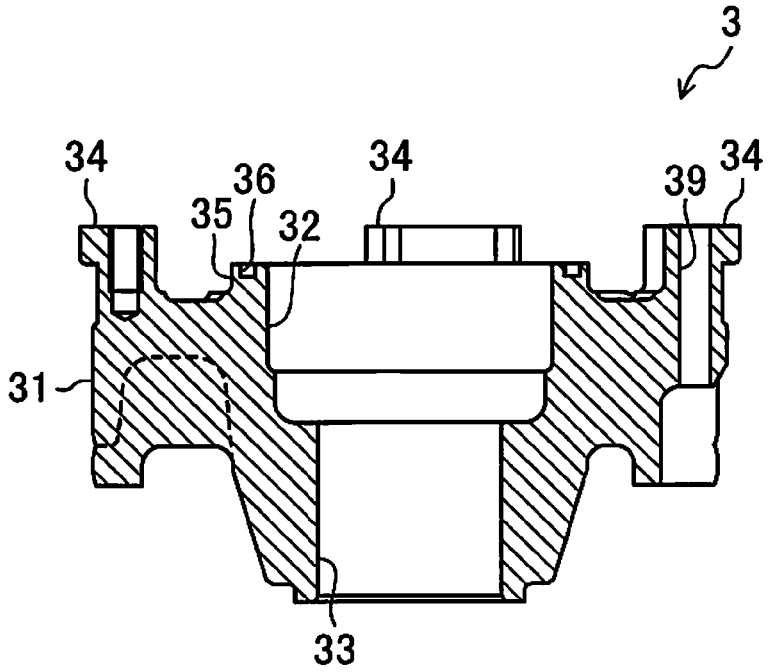

As illustrated in FIG. 3A, which is a top view, and FIG. 3B, which is a b-b sectional view of FIG. 3A, the housing (3) has a pan shape that is recessed at the center. The housing (3) includes an outer ring (31) and an inner recess (32).

As illustrated in FIGS. 1 and 2, the housing (3) is fixed to the upper edge of the casing body (11) by press fitting. Specifically, the outer peripheral surface of the ring (31) of the housing (3) is in close contact with the inner peripheral surface of the casing body (11) in the full circumference. The housing (3) divides the inner space of the casing (10) into an upper space (16) and a lower space (17). The upper space (16) is a first space close to the compression mechanism (14). The lower space (17) is a second space housing the electric motor (6).

The housing (3) has a through hole (33) penetrating the housing (3) from the bottom of the recess (32) to the lower end of the housing (3). A bearing metal (20) is inserted in the through hole (33). The driving shaft (7) is inserted through the bearing metal (20). The housing (3) constitutes an upper bearing supporting the upper end of the driving shaft (7) such that the driving shaft (7) can rotate.

The fixed scroll (4) includes a fixed end plate (41), a fixed lap (42), and an outer wall (43). The fixed lap (42) has an involute spiral wall shape, projects from the front surface (i.e., the lower surface in FIG. 2) of the fixed end plate (41), and is integrated with the fixed end plate (41). The outer wall (43) surrounds the outer periphery of the fixed lap (42) and projects from the front surface of the fixed end plate (41). The end surface of the fixed lap (42) is substantially flush with the end surface of the outer wall (43). The fixed scroll (4) is fixed to the housing (3).

The orbiting scroll (5) includes a movable end plate (51), a movable lap (52), and a boss (53). The movable end plate (51) is in the shape of an approximately circular flat plate. The movable lap (52) has an involute spiral wall shape, projects from the front surface (i.e., the upper surface in FIG. 2) of the movable end plate (51), and is integrated with the movable end plate (51). The boss (53) has a cylindrical shape, and is disposed at the center of the back surface (57) of the movable end plate (51).

The movable lap (52) of the orbiting scroll (5) is engaged with the fixed lap (42) of the fixed scroll (4). In the compression mechanism (14), the fixed lap (42) and the movable lap (52) are engaged with each other to form a compression chamber (50). Around the compression chamber (50), the fixed end plate (41) and the movable end plate (51) are in pressure contact with each other and form a thrust sliding surface (80).

A portion of the tip surface (i.e., the lower surface in FIG. 2) of the outer wall (43) of the fixed scroll (4) along the inner edge of the outer wall (43) serves as a fixed slidable-contact surface (84) that is in slidable contact with the movable end plate (51) of the orbiting scroll (5). A portion of the front surface (i.e., the upper surface in FIG. 2) of the movable end plate (51) of the orbiting scroll (5) surrounding the movable lap (52) serves as a movable slidable-contact surface (85) that is in slidable contact with the fixed slidable-contact surface (84) of the fixed scroll (4).

The outer wall (43) of the fixed scroll (4) has a suction port (25). The suction port (25) is connected to an downstream end of the suction pipe (18). The suction pipe (18) penetrates the upper wall (12) of the casing (10) and extends to the outside of the casing (10). A discharge port (44) penetrating the fixed end plate (41) of the fixed scroll (4) is formed in the center of the fixed end plate (41).

A high-pressure chamber (45) is formed in the center of the back surface (i.e., the upper surface in FIG. 2) of the fixed end plate (41). The discharge port (44) is open to the high-pressure chamber (45). The high-pressure chamber (45) constitutes a high-pressure space.

The fixed scroll (4) has a first flow passage (46) that communicates with the high-pressure chamber (45). The first flow passage (46) extends radially outward from the high-pressure chamber (45) in the back surface of the fixed end plate (41), extends in the outer wall (43) in an outer peripheral portion of the fixed end plate (41), and is open at the tip surface (i.e., the lower surface in FIG. 2) of the outer wall (43). A cover member (47) covering the high-pressure chamber (45) and the first flow passage (46) is attached to the back surface of the fixed end plate (41). The cover member (47) hermetically separates the high-pressure chamber (45) and the first flow passage (46) from the upper space (16) so that refrigerant gas discharged to the high-pressure chamber (45) and the first flow passage (46) does not leak into the upper space (16).

The fixed end plate (41) is provided with a distribution mechanism that guides refrigerant from the compression chamber (50) to the upper space (16) of the casing (10). The distribution mechanism is configured to allow a back-pressure space (24), which will be described later, and the upper space (16) to communicate with the compression chamber (50) in which refrigerant is being compressed, and includes an intermediate-pressure passage (48) connecting the compression chamber (50) and the upper space (16) to each other. The volume of the compression chamber (50) gradually decreases from when a suction port is completely closed to when the discharge port (44) is open to the compression chamber (50). An end of the intermediate-pressure passage (48) facing the compression chamber (50) is open to the compression chamber (50) at an intermediate pressure having a predetermined volume.

A reed valve (49) is provided on the back surface of the fixed end plate (41) of the fixed scroll (4). The reed valve (49) is a check valve that opens or closes an opening of the intermediate-pressure passage (48) facing the upper space (16). When the pressure of the compression chamber (50) exceeds the pressure of the upper space (16) by a predetermined value, the reed valve (49) opens, or otherwise the reed valve (49) closes. When the reed valve (49) opens, the compression chamber (50) and the upper space (16) communicate with each other through the intermediate-pressure passage (48). As a result, the pressure of the upper space (16) becomes an intermediate pressure that is higher than the pressure (a suction pressure) of a low-pressure gas refrigerant sucked into the compression chamber (50) and is lower than the pressure (a discharge pressure) of high-pressure gas refrigerant discharged from the compression chamber (50).

As illustrated in FIGS. 3A and 3B, the ring (31) of the housing (3) includes four attachment portions (34, 34, . . . ) for mounting the fixed scroll (4). The attachment portions (34, 34, . . . ) have screw holes to which the fixed scroll (4) is bolted.

One of the attachment portions (34, 34, . . . ) has a second flow passage (39) that passes through the ring (31). The second flow passage (39) is disposed so as to communicate with the first flow passage (46) of the fixed scroll (4) when the fixed scroll (4) is attached to the housing (3). Refrigerant gas discharged from the compression chamber (50) to the high-pressure chamber (45) passes through the first flow passage (46) and the second flow passage (39) in this order, and flows into the lower space (17) of the casing (10).

An inner circumferential wall (35) having a ring shape surrounding the center recess (32) is formed in an inner portion of the ring (31). The inner circumferential wall (35) is lower than that of the attachment portions (34, 34, . . . ), and is higher than the other portion (except the attachment portions (34, 34, . . . )) of the ring (31).

A seal groove (36) having a ring shape is formed in the tip surface (i.e., the upper surface in FIG. 2) of the inner circumferential wall (35) and extends along the inner circumferential wall (35). As illustrated in FIG. 2, an annular seal ring (37) is fitted in the seal groove (36). The seal ring (37) closes a gap between the housing (3) and the movable end plate (51) when being in contact with the back surface (57) of the movable end plate (51) of the orbiting scroll (5).

In the compression mechanism (14), a back-pressure space (22) is formed between the housing (3) and the fixed scroll (4). The back-pressure space (22) is divided by the seal ring (37) into a first back-pressure space (23) at an inner side of the seal ring (37) and a second back-pressure space (24) located at an outer side of the seal ring (37).

The first back-pressure space (23) communicates with the lower space (17) of the casing (10) through a minute gap formed in a sliding surface between the bearing metal (20) and the driving shaft (7). Although not shown, the housing (3) has an oil discharge passage that is open to the bottom of the first back-pressure space (23). The oil discharge passage allows the first back-pressure space (23) and the lower space (17) to communicate with each other so that lubricating oil in the first back-pressure space (23) can be discharged to the lower space (17).

In the first back-pressure space (23), the eccentric portion (72) of the driving shaft (7) and the boss (53) of the orbiting scroll (5) are disposed. The eccentric portion (72) is placed in the boss (53) of the orbiting scroll (5) such that the eccentric portion (72) can rotate. The oil passage (74) is open at the upper end of the eccentric portion (72). Specifically, high-pressure lubricating oil is supplied into the boss (53) from the oil passage (74), and the sliding surface between the boss (53) and the eccentric portion (72) is lubricated with the lubricating oil. An in-boss space (58) formed between the upper end surface of the eccentric portion (72) and the back surface (57) of the movable end plate (51) constitutes a high-pressure space.

The second back-pressure space (24) is a space facing the outer peripheral surface (56) and the back surface (57) of the movable end plate (51), and constitutes an intermediate-pressure space. The second back-pressure space (24) communicates with the upper space (16) through a gap between the housing (3) and the fixed scroll (4). The second back-pressure space (24) may be a high-pressure space.

The attachment portions (34, 34, . . . ) of the housing (3) to which the fixed scroll (4) is attached project upward in the ring (31) as illustrated in FIGS. 3A and 3B. Thus, a gap is formed between the fixed scroll (4) and the ring (31) of the housing (3) in a portion except the attachment portions (34, 34, . . . ). Through this gap, the second back-pressure space (24) and the upper space (16) communicate with each other.

The second back-pressure space (24) is provided with an Oldham coupling (55). The Oldham coupling (55) is engaged with a key groove (54) formed in the back surface (57) of the movable end plate (51) of the orbiting scroll (5) and key grooves (38, 38) formed in the ring (31) of the housing (3), and controls revolution of the orbiting scroll (5).

<Configuration of Oil Groove>

Figure 4:
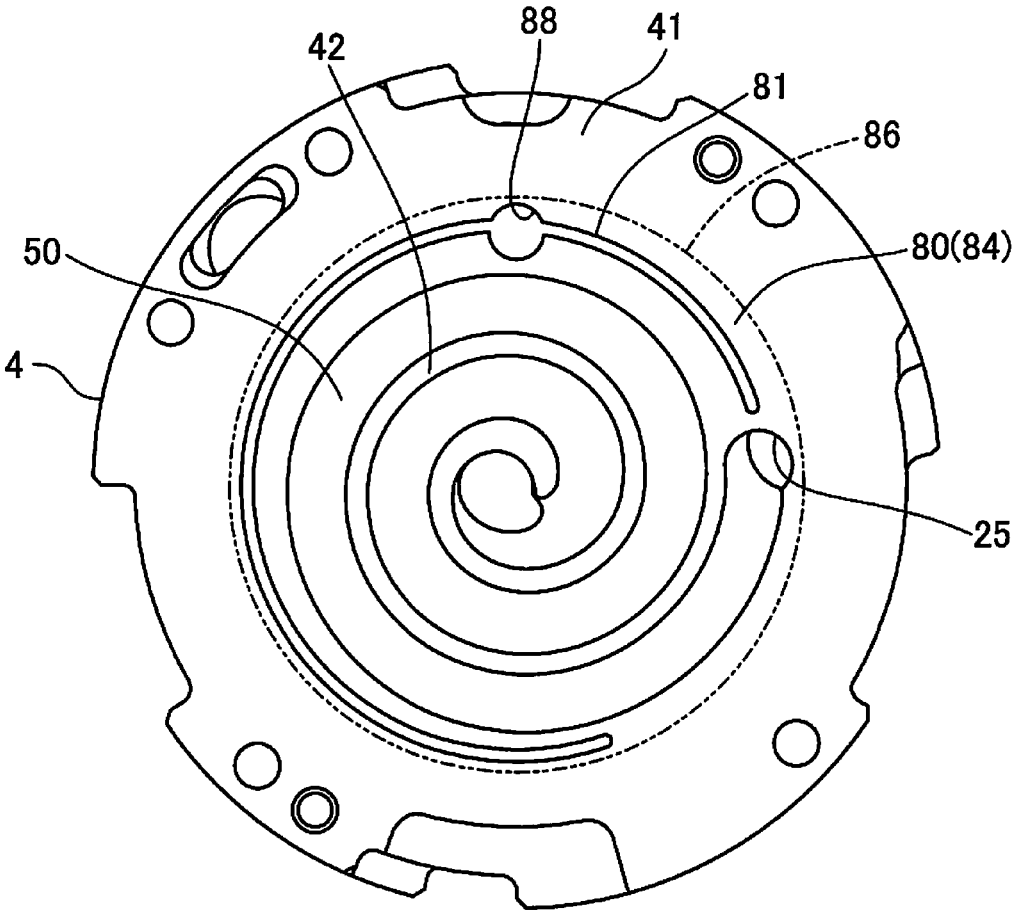
FIG. 4 is a bottom view of a fixed scroll.
Figure 5:
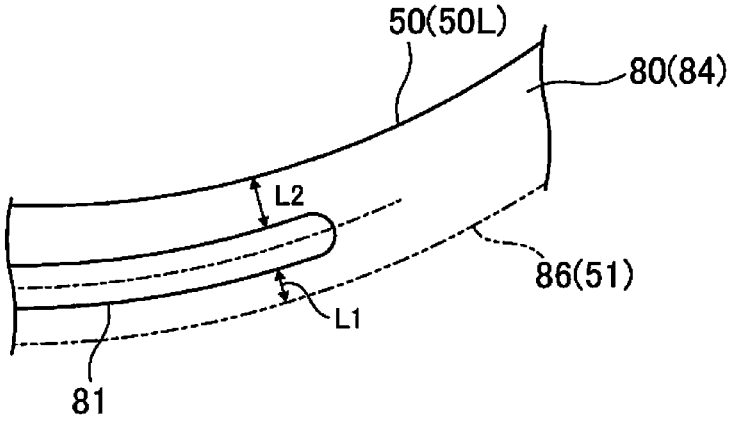
FIG. 5 is a partial enlarged view of FIG. 4.
Figure 6:
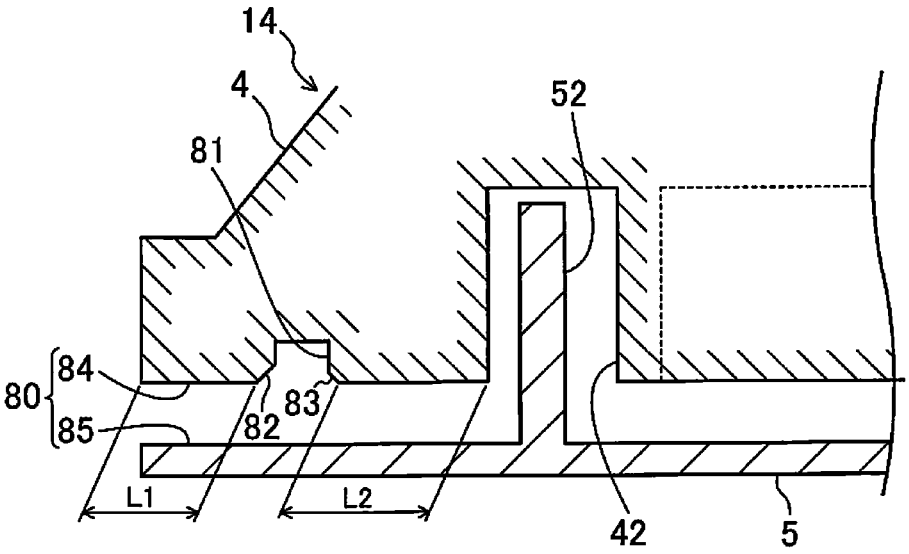
FIG. 6 is a partial enlarged view of the compression mechanism.

As illustrated in FIG. 4, which is a bottom view of the fixed scroll (4), FIG. 5, which is a partial enlarged view of FIG. 4, and FIG. 6, which is a partial enlarged view of the compression mechanism (14), an oil groove (81) to which high-pressure refrigerating machine oil is supplied is formed in the thrust sliding surface (80) in the compression mechanism (14). Specifically, the oil groove (81) is a groove formed in the fixed slidable-contact surface (84) at the bottom of the fixed end plate (41), and has an arc shape extending along the periphery of the compression chamber (50). As described above, the fixed slidable-contact surface (84) is formed along the inner edge of the lower surface of the outer wall (43) of the fixed scroll (4). Specifically, an envelope (86) of the outer peripheral surface (56) of the movable end plate (51) when the orbiting scroll (5) orbits serves as an outer edge of the fixed slidable-contact surface (84).

On the other hand, an oil supply passage (87) is formed in the movable end plate (51) of the orbiting scroll (5). The oil supply passage (87) is open to the in-boss space (58) at an inflow end thereof, and is open to the movable slidable-contact surface (85) of the movable end plate (51) at an outflow end thereof. When the orbiting scroll (5) revolves, the outflow end of the oil supply passage (87) also orbits in an orbit with a radius corresponding to the orbit of the orbiting, scroll (5). In the fixed slidable-contact surface (84), a communication recess (88) for always allowing the oil supply passage (87) and the oil groove (81) to communicate with each other when the orbiting scroll (5) revolves. The communication recess (88) is a middle part of the oil groove (81) that widens radially inward and outward in the orbiting scroll (5). The foregoing configuration causes high-pressure oil in the in-boss space (58) to be always supplied to the oil groove (81) when the orbiting scroll (5) orbits.

Figure 7:
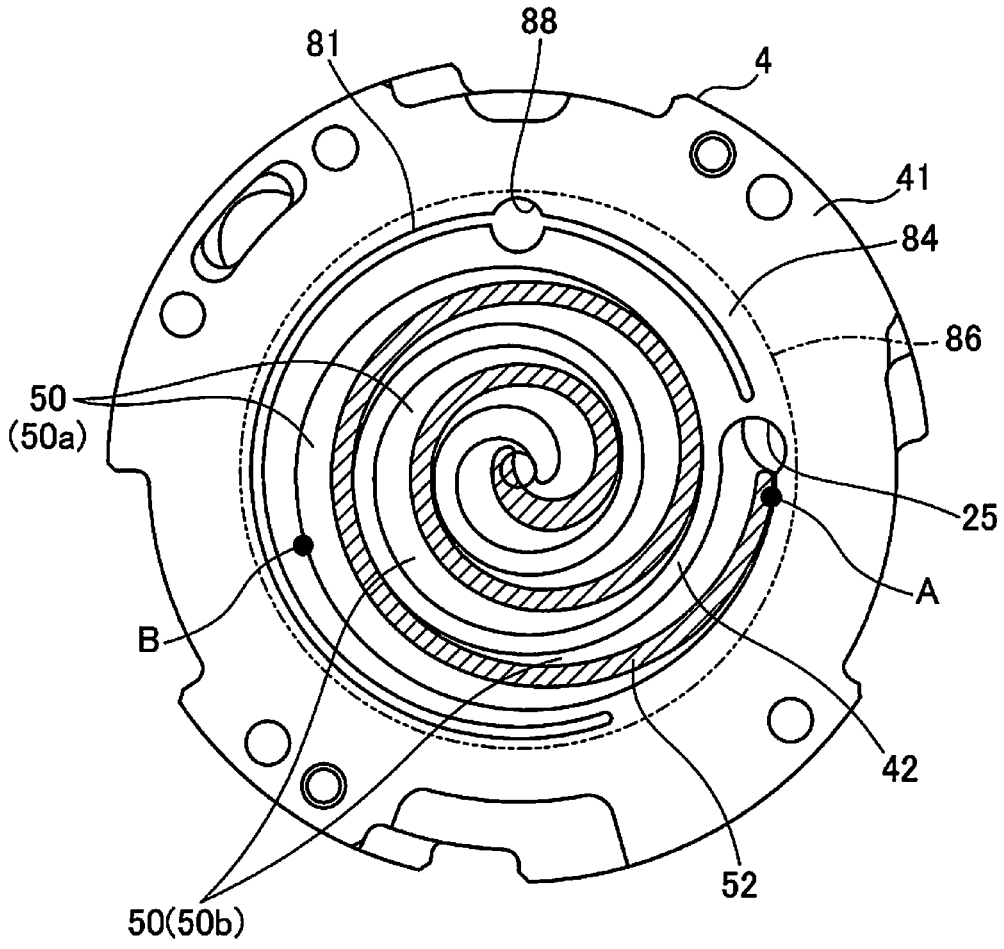
FIG. 7 is a bottom view of the fixed scroll and illustrates a first engaged state of a fixed lap and a movable lap.
Figure 8:
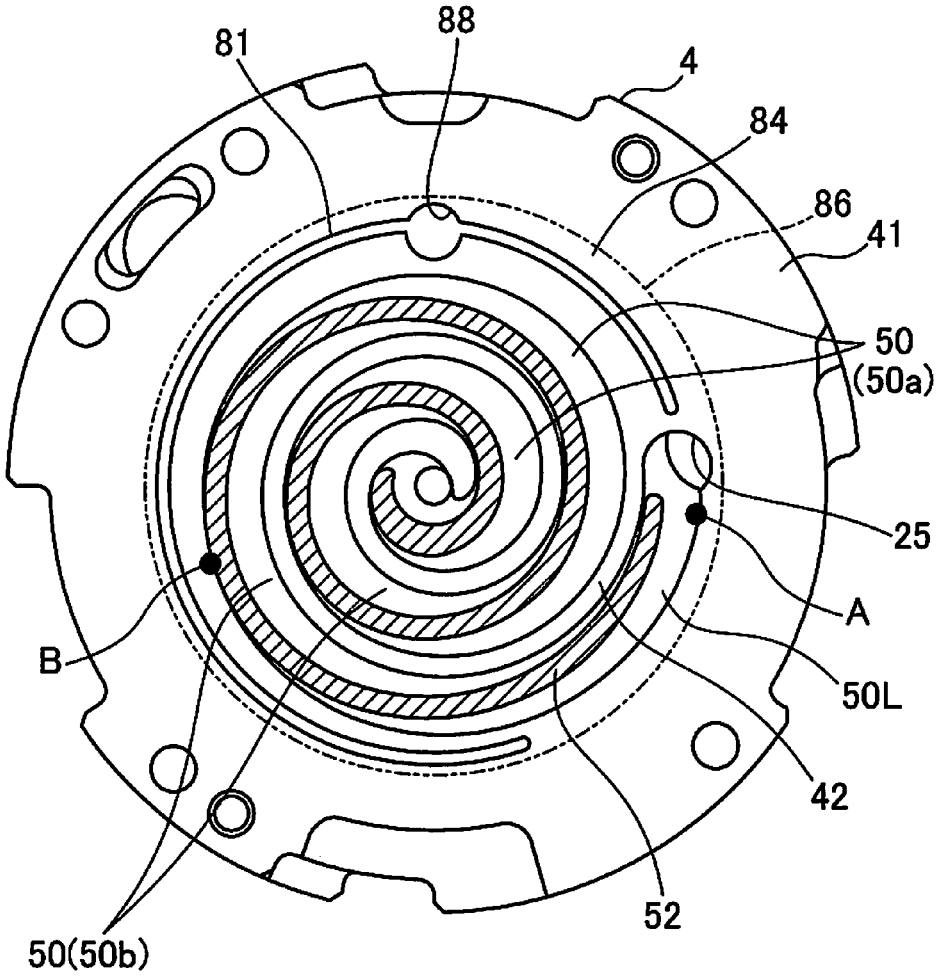
FIG. 8 is a bottom view of the fixed scroll and illustrates a second engaged state of the fixed lap and the movable lap.

FIGS. 7 and 8 are bottom views of the fixed scroll (4). FIG. 7 illustrates a first engaged state of the fixed lap (42) and the movable lap (52). FIG. 8 illustrates a second engaged state of the fixed lap (42) and the movable lap (52). Specifically, FIG. 7 illustrates a position at which the suction port of the first compression chamber (50*a*) formed at an outer side of the movable lap (52) is completely closed. FIG. 8 illustrates a position at which the suction port of the second compression chamber (50*b*) formed at an inner side of the movable lap (52) is completely closed.

In FIGS. 7 and 8, point A indicates a compression start position (a suction-port closed position) of the first compression chamber (50*a*). Point B indicates a position at which the orbiting scroll (5) orbits 180° from the compression start position. Between point A and point B, the length of time in which the compression chamber (50) communicates with the suction port (25) is long in a turn of the driving shaft (7), and the region between point A and point B is at a low pressure in more than a half of one turn.

A region from point A to point B is a suction space of fluid at an outer side of the compression chamber (50), i.e., a space to be a low-pressure space (50 L). In this embodiment, in orbiting of the orbiting scroll (5), at least in a portion corresponding to a region (a region from point A to point B) (50 L) to be a suction space of fluid at an outer side of the compression chamber (50), as illustrated in FIGS. 5 and 6, an outer seal length (L1) from an outer peripheral edge of the oil groove (81) to an "outer edge (86) of the movable end plate (51)" in the thrust sliding surface (80) is smaller than an inner seal length (L2) from an inner peripheral edge of the oil groove (81) to an "edge of the compression chamber (50)." In this configuration, the "outer edge (86) of the movable end plate (51)" corresponds to the "envelope (86) of the outer peripheral surface (56) of the movable end plate (51) when orbiting scroll (5) orbits" described above, and the "edge of the compression chamber (50)" corresponds to the "inner surface of an outermost fixed lap (42)."

Since the orbiting scroll (5) revolves about the driving shaft (7), the location of the outer peripheral surface (56) of the movable end plate (51) changes in accordance with the revolution, and the outer seal length (L1) of the thrust sliding surface (80) also changes. In this embodiment, the outer seal length (L1) is determined such that the minimum outer seal length (L1) is smaller than the smaller than the inner seal length (L2) in a state in which at least the minimum outer seal length (L1) in the revolution of the orbiting scroll (5) is at minimum when the orbiting scroll (5) orbits. That is, when at least the outer seal length (L1) is at minimum, this outer seal length (L1) is smaller than the inner seal length (L2).

As illustrated in FIG. 6, the oil groove (81) has an outer peripheral chamfer (82) and an inner peripheral chamfer (83). In this embodiment, the size of the outer peripheral chamfer (82) is larger than that of the inner peripheral chamfer (83).

Operation of Scroll Compressor

Operation of the scroll compressor (1) will now be described.

<Operation of Compressing Refrigerant>

When the electric motor (6) operates, the orbiting scroll (5) of the compression mechanism (14) is driven by the driving shaft (7). The orbiting scroll (5) revolves about the shaft center of the driving shaft (7) in an orbit with a radius corresponding to an eccentricity amount of the eccentric portion (72) with rotation of the orbiting scroll (5) being prevented by the Oldham coupling (55). The revolution of the orbiting scroll (5) causes low-pressure gas refrigerant from the suction pipe (18) to be sucked and compressed in the compression chamber (50) of the compression mechanism (14).

The compressed refrigerant (i.e., high-pressure gas refrigerant) is discharged from the discharge port (44) of the fixed scroll (4) into the high-pressure chamber (45). The high-pressure refrigerant gas that has flowed into the high-pressure chamber (45) passes through the first flow passage (46) of the fixed scroll (4) and the second flow passage (39) of the housing (3) in this order, and flow out into the lower space (17) of the casing (10). The refrigerant gas that has flowed into the lower space (17) is discharged to the outside of the casing (10) through the discharge pipe (19).

<Operation of Pressing Orbiting Scroll Against Fixed Scroll>

The lower space (17) of the casing (10) is at a pressure (i.e., a discharge pressure) equal to that of high-pressure gas refrigerant discharged from the compression mechanism (14). Thus, the pressure of lubricating oil stored in the oil sump (15) below the lower space (17) is substantially equal to the discharge pressure.

High-pressure lubricating oil in the oil sump (15) flows from the lower end to the upper end of the oil passage (74) of the driving shaft (7), and flows into the in-boss space (58) of the orbiting scroll (5) through the opening in the upper end of the eccentric portion (72) of the driving shaft (7). Part of the lubricating oil supplied to the in-boss space (58) lubricates the sliding surface between the boss (53) and the eccentric portion (72), and flows out into the first back-pressure space (23). The lubricating oil that has flowed into the first back-pressure space (23) is discharged to the lower space (17) through the oil discharge passage (not shown). The first back-pressure space (23) communicates with the lower space (17) through the oil discharge passage. Thus, the pressure of the first back-pressure space (23) is substantially equal to the discharge pressure.

The other part of the lubricating oil supplied to the in-boss space (58) is supplied to the oil groove (81) through the oil supply passage (87). The lubricating oil supplied to the oil groove (81) spreads over the thrust sliding surface (80) and forms an oil film, thereby lubricating the fixed slidable-contact surface (84) and the movable slidable-contact surface (85) and sealing a gap between the compression chamber (50) and the second back-pressure space (24).

An intermediate-pressure passage (48) is formed in the fixed end plate (41) of the fixed scroll (4). Thus, when the reed valve (49) opens, part of refrigerant that is being compressed in the compression chamber (50) of the compression mechanism (14) flows into the upper space (16) in the casing (10) through the intermediate-pressure passage (48). The upper space (16) communicates with the second back-pressure space (24) at the back surface of the orbiting scroll (5). Thus, the pressure of the second back-pressure space (24) is a pressure (i.e., an intermediate pressure) substantially equal to the pressure of gas refrigerant that is being compressed.

A fluid pressure (a discharge pressure) in the first back-pressure space (23) and a fluid pressure (an intermediate pressure) in the second back-pressure space (24) are applied onto the back surface (57) of the movable end plate (51) of the orbiting scroll (5). Thus, a pressing force is applied to the orbiting scroll (5) in an axial direction such that the orbiting scroll (5) is pressed against the fixed scroll (4).

A refrigerant pressure in the compression chamber (50) and a pressure of lubricating oil in the oil groove (81) are applied onto the front surface of the movable end plate (51) of the orbiting scroll (5). Thus, a force in an axial direction (i.e., a repelling force) of urging the orbiting scroll (5) to move away from the fixed scroll (4) acts on the orbiting scroll (5). On the other hand, in the compression mechanism (14), a pressing force acts on the orbiting scroll (5), and the orbiting scroll (5) is pressed against the fixed scroll (4) in opposition to the repelling force. Consequently, a tilt (an overturn) of the orbiting scroll (5) due to the repelling force can be reduced.

If the pressing force is excessively greater than the repelling force, a large friction force acts on the fixed scroll (4) and the orbiting scroll (5) and increases a loss, thereby reducing the efficiency of the scroll compressor (1). On the other hand, if the pressing force is excessively smaller than the repelling force, the orbiting scroll (5) easily tilts, and the amount of leakage of refrigerant from the compression chamber (50) increases, resulting in a decrease in performance of the scroll compressor (1). This causes a local abrasion of the fixed scroll (4) and the orbiting scroll (5) and the reliability of the scroll compressor (1) decreases.

In the scroll compressor (1) of this embodiment, the ratio between the area on which the discharge pressure acts and the area on which the intermediate pressure acts in the back surface of the orbiting scroll (5), the location of the opening at the compression chamber (50) of the intermediate-pressure passage (48) formed in the fixed scroll (4), and the release pressure of the reed valve (49) in the fixed scroll (4) are appropriately adjusted, thereby applying an appropriate pressing force to the orbiting scroll (5).

In this manner, the scroll compressor (1) of this embodiment is designed such that an appropriate pressing force acts on the orbiting scroll (5). Thus, the orbiting scroll (5) hardly tilts as long as the scroll compressor (1) operates under operating conditions expected in design and the operating state of, for example, the rotation speed of the electric motor (6) is kept within a range, i.e., in a steady state.

In addition, in this embodiment, the oil groove (81) in the thrust sliding surface (80) can prevent overturn of the orbiting scroll (5) in the following manner.

First, the outer second back-pressure space (24) at the back surface of the movable end plate (41) is at an intermediate pressure. Lubricating oil (refrigerating machine oil) in the oil groove (81) flows into the outer second back-pressure space (24) at the intermediate pressure at the back surface of the movable end plate (41) and the low-pressure space (a space communicating with the low-pressure side before the suction port is completely closed) (50 L) at the suction side of the compression chamber (50). In this embodiment, the outer seal length (L1) is smaller than the inner seal length (L2) while the orbiting scroll (5) orbits. Thus, the high-pressure oil in the oil groove (81) flows not only into the low-pressure space (50 L) at the suction side of the compression chamber (50) but also into the outer second back-pressure space (24) at the back surface of the movable end plate (41) easily.

Accordingly, in this embodiment, oil also easily spreads to an outer peripheral portion of the oil groove (81), and thus, a different in formation state of an oil film does not easily occur between the inner peripheral portion and the outer peripheral portion of the oil groove (81). Thus, a failure is less likely to occur in sealing the thrust sliding surface (80) in the outer peripheral portion of the oil groove (81). As a result, the pressure of the outer second back-pressure space (24) at the back surface of the movable end plate (41) can be maintained, thereby also reducing overturn of the orbiting scroll (5).

In this embodiment, in a case where at least the outer seal length (L1) is at minimum during orbiting of the orbiting scroll (5), this outer seal length (L1) is smaller than the inner seal length (L2). Thus, the high-pressure oil in the oil groove (81) always easily flows into the second back-pressure space (24) at the back surface of the movable end plate (41) while the orbiting scroll (5) orbits, and accordingly, oil also easily spreads to the outer peripheral portion of the oil groove (81) in the thrust sliding surface (80).

In particular, the oil groove (81) has the inner peripheral chamfer (83) and the outer peripheral chamfer (82) such that the size of the outer peripheral chamfer (82) is larger than that of the inner peripheral chamfer (83). In this manner, high-pressure oil easily flows into the outer peripheral portion of the oil groove (81), and thus, oil easily spreads to the outer peripheral portion of the oil groove (81) in the thrust sliding surface (80).

Advantages of Embodiment

In this embodiment, the outer second back-pressure space (24) at the back surface of the movable end plate (41) is at the intermediate pressure, the pressure difference between the oil groove (81) and the low-pressure space (50 L) at the suction side of the compression chamber (50) is larger than the pressure difference between the oil groove (81) and the second back-pressure space (24), and the outer seal length (L1) is smaller than the inner seal length (L2) while the orbiting scroll (5) orbits. Thus, as described above, high-pressure oil in the oil groove (81) flows not only into the low-pressure space (50 L) at the suction side of the compression chamber (50) but also into the second back-pressure space (24) at the back surface of the movable end plate (41) easily. In the thrust sliding surface (80), oil easily spreads to the outer peripheral portion of the oil groove (81).

This configuration can reduce the possibility of a sealing failure in the thrust sliding surface (80) in the outer peripheral portion of the oil groove (81). Consequently, the pressure of the second back-pressure space (24) at the back surface of the movable end plate (41) can be maintained, and overturn of the orbiting scroll (5) can be reduced, thereby reducing a decrease in performance and reliability of the compressor (1). Occurrence of a sealing failure in the thrust sliding surface (80) might cause a large amount of high-pressure lubricating oil to flow from the low-pressure space (50 L) into the compression chamber (50). However, in this embodiment, a small amount of high-pressure oil in the oil groove (81) flows from a low-pressure space (50 L) into the compression chamber (50), thereby reducing a decrease in efficiency of the compressor (1).

In addition, in this embodiment, in a case where at least the outer seal length (L1) is at minimum during orbiting of the orbiting scroll (5), this outer seal length (L1) is smaller than the inner seal length (L2). Thus, high-pressure oil in the oil groove (81) also always flows into the second back-pressure space (24) at the back surface of the movable end plate (41) easily during orbiting of the orbiting scroll (5). At this time, oil always easily spreads to the outer peripheral portion of the oil groove (81). Thus, a sealing failure in the thrust sliding surface (80) is less likely to occur in the outer peripheral portion of the oil groove (81). This also contributes to a decrease in performance degradation caused by overturn of the orbiting scroll (5), and can reduce a decrease in performance and reliability of the compressor (1).

In particular, since the oil groove (81) has the inner peripheral chamfer (83) and the outer peripheral chamfer (82) and the size of the outer peripheral chamfer (82) is larger than the inner peripheral chamfer (83), high-pressure oil easily spreads to the outer peripheral portion of the oil groove (81). Thus, oil easily spreads to the outer peripheral portion of the oil groove (81) in the thrust sliding surface (80). Since oil easily spreads to the outer peripheral portion of the oil groove (81) and a sealing failure is less likely to occur in the outer peripheral portion of the oil groove (81), it is possible to reduce overturn of the orbiting scroll (5) and a decrease in performance and reliability of the compressor (1) accordingly.

Variations of Embodiment (First Variation)

Figure 9:
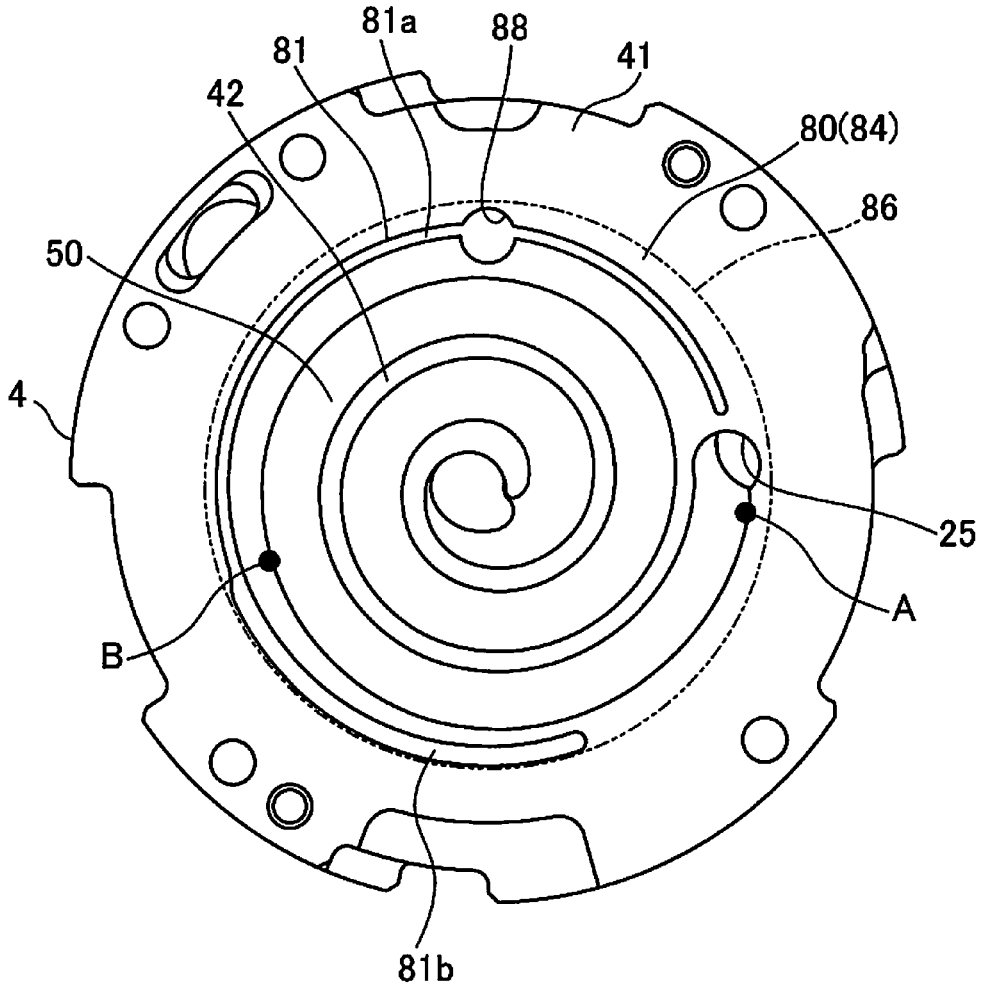
FIG. 9 is a bottom view of a fixed scroll according to a variation of the embodiment.

The oil groove (81) may have a configuration illustrated in FIG. 9. In the oil groove (81) according to a first variation of the embodiment, suppose an inflow end of high-pressure oil is a proximal portion (81*a*) and a portion formed around a region where the compression chamber (50) serves as a suction space (50 L) of fluid is a distal portion (81*b*), at least one of the width or the depth of the oil groove (81) is larger in the distal portion (81*b*) than in the proximal portion (81*a*).

In this configuration, high-pressure oil that has flowed from the proximal portion (81*a*) into the oil groove (81) has its pressure reduced in the distal portion (81*b*) because the width or the depth of the oil groove (81) is large in the distal portion (81*b*). Thus, the difference between the pressure of oil and the pressure of a low-pressure space (50 L) at the suction side of the compression chamber (50) decreases, and the amount of oil that flows into the compression chamber (50) decreases. Accordingly, operation can be performed efficiently, thereby enhancing performance of the compressor (1). If a large amount of lubricating oil flowed into the compression chamber (50), the lubricating oil would be discharged to the outside of the compressor (1) together with refrigerant so that unwanted oil discharge would occur easily. On the other hand, in the first variation, occurrence of such unwanted oil discharge can be reduced, thereby enhancing reliability of the compressor (1).

(Second Variation)

Figure 10:
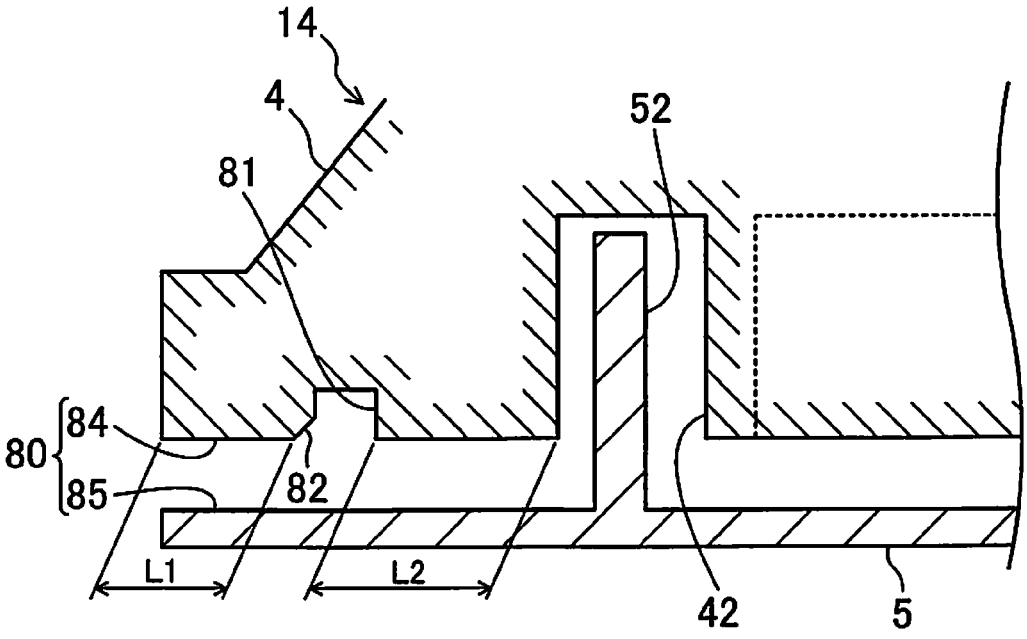
FIG. 10 is a partial enlarged view of a compression mechanism according to the variation.

In the above-described embodiment, the outer peripheral chamfer (82) is formed at the outer periphery of the oil groove (81), and the inner peripheral chamfer (83) is formed at the inner periphery of the oil groove (81). Alternatively, as illustrated in FIG. 10, the outer peripheral chamfer (82) may be formed only at the outer periphery of the oil groove (81) without formation of the inner peripheral chamfer (83) at the inner periphery of the oil groove (81). In this configuration, high-pressure lubricating oil in the oil groove (81) also easily flows into the outer portion rather than the inner peripheral portion of the oil groove (81). Thus, overturn of the orbiting scroll (5) can be reduced with a decrease in sealing property at the outer periphery of the thrust sliding surface (80) in a manner similar to the embodiment. As a result, a decrease in performance of the compressor (1) can be reduced.

Other Embodiments

The embodiment may have the following configurations.

For example, in the embodiment, the present disclosure is applied to the scroll compressor (1) with the asymmetrical spiral structure in which the number of turns differs between the fixed lap (42) and the movable lap (52). However, the present disclosure is also applicable to a scroll compressor (1) with a symmetrical spiral structure in which the number of turns of the fixed lap (42) is equal to that of the movable lap (52).

The outer peripheral chamfer (82) and the inner peripheral chamfer (83) formed in the embodiment do not need to be formed.

In the embodiment, the outer seal length (L1) is smaller than the inner seal length (L2) only in the range between point A and point B. Alternatively, the configuration in which the outer seal length (L1) is smaller than the inner seal length (L2) can provide advantages in obtaining a sealing property of the thrust sliding surface (80) for reasons similar to those of the embodiment even in a portion where the pressure of the compression chamber (50) gradually increases as long as the pressure of the compression chamber (50) is lower than the pressure of the second back-pressure space (24).

In the embodiment, when the outer seal length (L1) that is at minimum is smaller than the inner seal length (L2). However, the dimensional relationship between the outer seal length (L1) and the inner seal length (L2) is not limited to the case where the outer seal length (L1) is at minimum.

The foregoing embodiment is a merely preferred example in nature, and is not intended to limit the scope, applications, and use of the disclosure.

INDUSTRIAL APPLICABILITY

As described above, the present disclosure is useful for a sealing structure of a thrust sliding surface between a fixed scroll and an orbiting scroll in a scroll compressor.

What is claimed is:

1. A scroll compressor comprising:

a compression mechanism including a fixed scroll having a fixed end plate and a spiral fixed lap integrated with the fixed end plate, and an orbiting scroll having a movable end plate and a spiral movable lap integrated with the movable end plate, the fixed lap and the movable lap being engaged with each other to form a compression chamber, the fixed end plate and the movable end plate being in pressure contact with each other around the compression chamber to form a thrust sliding surface, the thrust sliding surface having an oil groove located therein that extends around the compression chamber, high-pressure refrigerating machine oil being supplied to the oil groove, during orbiting of the orbiting scroll, at least in a region serving as a suction space of fluid in an outer peripheral portion of the compression chamber, an outer seal length from an outer peripheral edge of the oil groove in the thrust sliding surface to an outer edge of the movable end plate is smaller than an inner seal length from an inner peripheral edge of the oil groove to a peripheral edge of the compression chamber, the oil groove having an outer peripheral chamfer and an inner peripheral chamfer, and a size of the outer peripheral chamfer being larger than a size of the inner peripheral chamfer.

2. The scroll compressor of claim 1, wherein in a state in which the outer seal length is at minimum when the orbiting scroll orbits, the outer seal length is smaller than the inner seal length.

3. A scroll compressor comprising:

a compression mechanism including a fixed scroll having a fixed end plate and a spiral fixed lap integrated with the fixed end plate, and an orbiting scroll having a movable end plate and a spiral movable lap integrated with the movable end plate, the fixed lap and the movable lap being engaged with each other to form a compression chamber, the fixed end plate and the movable end plate being in pressure contact with each other around the compression chamber to form a thrust sliding surface, the thrust sliding surface having an oil groove located therein that extends around the compression chamber, high-pressure refrigerating machine oil being supplied to the oil groove, during orbiting of the orbiting scroll, at least in a region serving as a suction space of fluid in an outer peripheral portion of the compression chamber, an outer seal length from an outer peripheral edge of the oil groove in the thrust sliding surface to an outer edge of the movable end plate is smaller than an inner seal length from an inner peripheral edge of the oil groove to a peripheral edge of the compression chamber, a portion of the oil groove corresponding to an inflow end of high-pressure oil being a proximal portion, a portion of the oil groove corresponding to a region in which the compression chamber is a suction space of fluid being a distal portion, and at least one of a width and a depth of the distal portion being larger than that of the proximal portion.

4. The scroll compressor of claim 3, wherein in a state in which the outer seal length is at minimum when the orbiting scroll orbits, the outer seal length is smaller than the inner seal length.

* * * * *